United States Patent [19]

Garner

[11] Patent Number: 4,554,782

[45] Date of Patent: Nov. 26, 1985

[54] MANUFACTURE OF TELECOMMUNICATIONS CABLE CORE UNITS

[75] Inventor: John N. Garner, Kingston, Canada

[73] Assignee: Northern Telecom Limited, Montreal, Canada

[21] Appl. No.: 637,586

[22] Filed: Aug. 3, 1984

[51] Int. Cl.[4] ..... H01B 11/04; D01H 1/04; D07B 1/06; D07B 3/12

[52] U.S. Cl. ..... 57/66; 57/6; 57/13; 57/14; 57/68; 57/314; 57/352

[58] Field of Search ..... 57/314, 12, 13, 14, 57/283, 293, 352, 294, 68, 66, 6; 174/34; 74/82, 216.3, 70, 71

[56] References Cited

U.S. PATENT DOCUMENTS

| | | | |
|---|---|---|---|
| 1,211,221 | 1/1917 | Pfeiffer | 74/71 |
| 1,413,695 | 4/1922 | Voss | 74/71 |
| 2,412,196 | 12/1946 | Ashbaugh et al. | 57/314 X |
| 2,530,726 | 11/1950 | Rasmussen | 57/314 X |
| 3,307,415 | 3/1967 | Dobbs | 74/82 X |
| 3,369,355 | 2/1968 | Burr | 57/314 |
| 3,732,682 | 5/1973 | Crotty et al. | 57/314 X |

FOREIGN PATENT DOCUMENTS

| | | | |
|---|---|---|---|
| 493185 | 4/1954 | Italy | 74/216.3 |

OTHER PUBLICATIONS

*Multi-Paired Cable of Non Layer Design for Low Capacitance Unbalance Telecommunication Networks*, by Sigurd Norblad of Telefonaktiebolaget LM Ericsson, read before the International Wire and Cable Symposium in 1971.

*Primary Examiner*—John Petrakes
*Assistant Examiner*—Joseph J. Hail, III
*Attorney, Agent, or Firm*—R. J. Austin

[57] ABSTRACT

Changing relative positions of conductor pairs along a telecommunications cable core by passing the pairs, as they approach a core unit forming means, through guides which are held in relative positions in a guide channel. The channel extends in a plurality of directions and has inner and outer channel portions which are preferably arcuate and lie upon arcs of circles. The guides are moved along the channel and from channel portion to channel portion, movement being alternately in each direction. This movement changes the positional relationship of guides in one channel portion to those in the other.

2 Claims, 7 Drawing Figures

MANUFACTURE OF TELECOMMUNICATIONS CABLE CORE UNITS

This invention relates to the manufacture of telecommunications cable core units.

A telecommunications cable is constructed with a core comprising one or more core units, each having a multiplicity of twisted units of conductors, each unit conventionally being a twisted pair of conductors. A core may be formed as a single core unit of twisted pairs, e.g. 50 or 100 pairs, or larger cores, i.e. up to 3,600 twisted pairs, comprises a plurality of core units. The twisted pairs are stranded together to form a core unit with the conductors of each pair twisted together with a predetermined lead to the twist, i.e. the distance taken along the pair for each conductor to complete a single revolution along its path. This distance will be referred to in this specification as the "twist lay" of a pair. There are different twist lays provided for the twisted pairs in a core unit with a pair having a particular twist lay being adjacent to other pairs of different twist lays. Care is taken, so far as is practicable, to ensure that pairs of equal or similar twist lays are separated from each other. The reason for this arrangement is to attempt to maximize the communications performance of the cable, e.g. to lessen pair-to-pair capacitance unbalance, to reduce crosstalk between pairs, and to lower the coefficient of deviation of mutual capacitance of pairs in the cable.

In a conventional core unit, the twisted conductor pairs retain their positions relative to other pairs, within certain limits. However, it is recognized that the pair-to-pair capacitance unbalance and crosstalk between pairs is dependent to a large degree upon the distance of the two pairs from one another. To reduce the pair-to-pair capacitance unbalance and to improve the crosstalk, suggestions have been made to move the conductor pairs relative to one another as they progress towards a stranding machine for stranding them into a core unit so that in the finished core unit, the conductor pairs change in relative positions and distances apart. In a suggested method for changing the relative positions of conductor pairs as they move towards the stranding machine, the conductor pairs enter a guide arrangement which comprises a system of horizontal guides movable horizontally and located in vertically tiered fashion. The pairs are distributed throughout the tiers and relative horizontal movement of the guides changes the relative positions of the pairs as they move downstream. This method was first suggested by Sigurd Norblad of Telefonaktiebolaget LM Ericsson, in a paper entitled "Multi-Paired Cable of Non Layer Design for Low Capacitance Unbalance Telecommunication Networks" read before the International Wire and Cable Symposium in 1971. In this method, the conductor pairs need to be controllably arranged together in their changing relative positions preparatory to their passage into a closing die, in which they are drawn together to form the core unit. Controllable arrangement of the pairs should be possible by passing them from their various positions partly around a roller. However, extreme height of the Ericsson machine, even for changing positions of twenty-five pairs, is such that if one roller is used for the arrangement control, severe change in angles of feedpaths of some of the conductor pairs is required for them to pass around the roller. Such a severe change can cause damage to either the conductors or to their insulation, particularly if the insulation is made from pulp. Thus, two or more rollers in series are required for this operation so as to cause more gradual convergence of the pairs to a final roller before the closing die is reached.

The present invention concerns a method and apparatus for making core units involving changing the relative positions of conductor units before they are brought together to form a core unit, and in which the need for the use of a roller to controllably arrange the conductor units may be avoided.

Accordingly, the present invention provides an apparatus for forming a core unit from telecommunications conductor units, each formed from twisted together insulated conductors, and in which the relative positions of the conductor units are changed along the core unit, the apparatus comprising in order, downstream along a feedpath for the conductor units:

guide means for the conductor units to prevent them from being twisted together;

position changing means for the conductor units comprising a plurality of channel forming members which define between them an endless guide channel which extends transversely of the feedpath in a plurality of directions to provide an outer channel portion connected to an inner channel portion which is disposed within the outer channel portion, guides for conductor units held in laterally spaced relative positions in the channel, and means to move the guides along the channel in their spaced apart positions for a certain distance alternately in each direction so that the guides are moved from channel portion to channel portion and guides in one channel portion change in their positional relationship to those in the other channel portion; and a core unit forming and take-up means to draw the conductor units together to form the core unit.

In a preferred apparatus, the channel forming members form the channel with an arcuate outer channel portion and an arcuate inner channel portion, the two portions being interconnected at their ends. Each channel portion will thereby subtend an angle of less than 360°. In a preferred arrangement, the channel forming members comprise a rotatable annulus which surrounds an arcuate member to define the outer channel portion. The inner channel portion is defined between the arcuate member and an inner member disposed within it. Interconnecting channel portions extend between the inner and outer channel portions around the arcuate member and are defined between the arcuate member and a spacing member disposed between the ends of the spacing member.

In a practical construction, the rotatable annulus, arcuate member, inner member and spacing member are maintained in their relative positions to define the channel by the spaced apart guides located in the channel, and the spacing member and the inner member are mounted in position to a fixed support.

In use of the apparatus according to the invention, the geometry of the channel is such that the guides are moved in a plurality of different directions along the outer channel and along the inner channel such that the guides move in more than one direction relative to each other. Hence, in a horizontally positioned in-line apparatus, the guides in extending transversely of the feedpath must move both in vertical and horizontal directions or in directions having vertical and horizontal directional components. Thus, a thorough repositioning of the guides in all of these directions ensures that the conductor pairs upon leaving the position changing means do not need to be arranged positively before being drawn together to form a core unit. This is in contrast to apparatus which only moves conductor units relative to each other in a single direction and of necessity uses an arrangement roller to ensure there are positive changes in relative positions of the conductor units as they are fed together to form the core unit.

The invention also includes a method for forming a core unit in which the conductor units are changed in their relative positions in a plurality of directions so as to avoid the need for a roller for controllably arranging the units.

Thus, according to a further aspect of the present invention, there is provided a method of forming a core unit from telecommunications conductor units, each comprising twisted together insulated conductors, and in which the relative positions of the conductor units are changed along the core unit, the method comprising:

passing the separate conductor units along a feedpath while preventing them from twisting together;

passing the separate conductor units through guides which are laterally spaced-apart, and relatively moving the conductor units by simultaneously moving all of the guides transversely of the feedpath and in their spaced-apart relative positions alternately in two directions along a guide channel with the guides moving along either an outer channel portion or an inner channel portion disposed within the outer channel portion, with some guides moving from channel portion to channel portion so as to change the positional relationship of guides in one channel to those in the other and thereby relatively moving the conductor units; and forming the conductor units in their changing positions into a core unit, the relative positions of the conductor units in the core unit at any position along the length thereof influenced by the relative positions of the conductor units as they are being formed into the core unit.

One embodiment of the invention will now be described by way of example, with reference to the accompanying drawings, in which.

Figure 1:
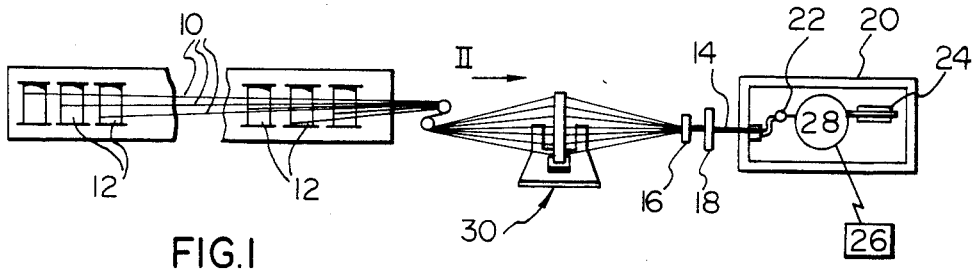
FIG. 1 is a side elevational view of an apparatus for forming a core unit from conductor pairs.

In the embodiment as shown in FIG. 1, twenty-five conductor pairs 10, each formed from two twisted together individually insulated conductors, are drawn from twenty-five reels 12 of the conductor pairs in conventional fashion for forming into a core unit 14. The core unit 14 is formed at the downstream end of the apparatus by passing the conductor pairs through a closing die 16 which draws the conductor pairs together, and a binding head 18 at which position a binding material is closed around the drawn together conductor pairs to hold them together.

A stranding machine 20 forms part of a core unit forming and take-up means which also includes the closing die 16 and binding head 18. The stranding machine 20 is of conventional construction and comprises a flying strander 22 with a "helper" capstan 24. The "helper" capstan is to assist in the drawing of the core unit 14 into the machine 20, the main force for which is taken by a motor 26 which drives a core unit take-up reel 28. As the stranding machine structure is conventional, no further description is required.

Upstream from the closing die 16 is a position changing means 30 for conductor pairs.

Figure 2:
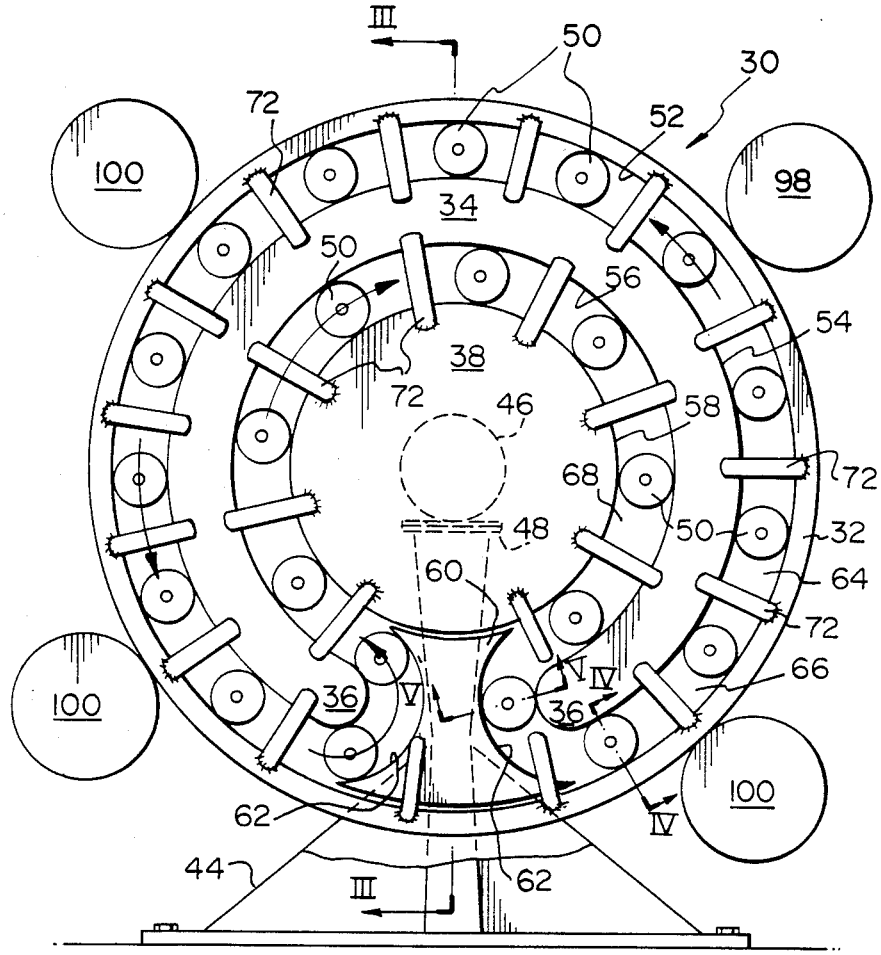
FIG. 2 is a view of part of the apparatus taken in the direction of arrow II in FIG. 1, while omitting part of a machine stand for clarity.
Figures 3, 4, 5, 6, 7:
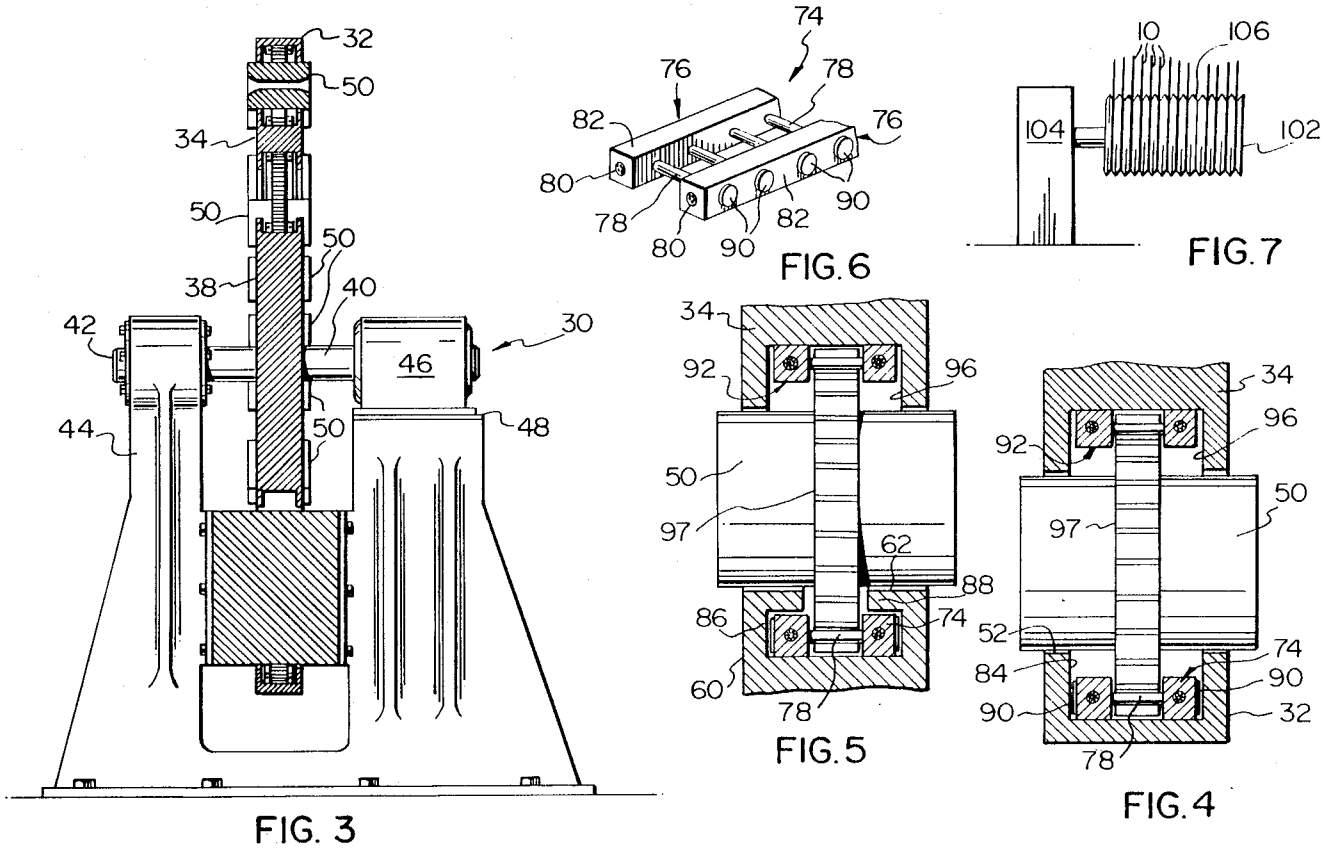
FIG. 3 is a view of the apparatus in FIG. 2 taken partly in side elevation and partly in cross-section along line III—III in FIG. 2.
FIGS. 4 and 5 are cross-sectional views through the apparatus along lines IV—IV and V—V in FIG. 2.
FIG. 6 is an isometric view of part of a drive chain forming part of the apparatus of FIG. 2.
FIG. 7 is a view of part of the apparatus in the direction of arrow II in FIG. 1, and on a larger scale.

As is more clearly shown in FIGS. 2 and 3, the position changing means 30 comprises a plurality of channel forming members which define between them an endless guide channel which extends transversely of the feedpath in a plurality of directions. The channel forming members comprise a rotatable annulus or axially short cylinder 32 surrounding an arcuate member 34 which extends substantially completely around the arc of a circle concentric with the cylinder 32, the arcuate member having a narrow gap between two ends 36 at a base of the member, as shown by FIG. 2. Disposed concentrically within the arcuate member 34 is an inner cylindrical member 38. As shown by FIG. 3, all of the forming members 32, 34 and 38 are of similar narrow axial width compared to their diameter. The inner member 38 is rotatably supported upon a driving shaft 40 (FIG. 3), which is mounted by one end 42 within a machine frame 44 and the other end is drivably connected to a reversing electric motor 46, which is secured to a platform 48 of the machine frame.

Guides are provided for the conductor pairs in the position changing means. These guides comprise twenty-five cylinders 50 which are mounted between the cylinder 32, arcuate member 34 and inner member 38. The guides to hold the member 34 and cylinder 32 concentrically around the inner member in its fixed rotational position, by the rolling engagement of the outer surface of each cylinder with the inner surface 52 of cylinder 32, outer and inner surfaces 54 and 56 of the arcuate member and the surface 58 of the inner member 38. A spacing member 60 is secured to the machine frame 44 in a position slightly below the inner member 38 so as to allow for rotation of the inner member. The spacing member, as shown by FIG. 2, has concave sides 62 shaped to be spaced a constant distance from curved surfaces of ends 36 to allow for the guides 50 to move around these ends while maintaining engagement with the ends 36 and also with the surfaces 62. Hence, this construction forms an endless guide channel 64 which extends transversely of the feedpath in a plurality of directions, i.e. is curved to provide horizontal and vertical directional components. The channel 64 comprises an outer channel portion 66 defined between the cylinder 32 and arcuate meaber 34 and an inner channel portion 68 which is disposed within the outer channel and is formed between the arcuate member 32 and the inner member 38. The channel portions 66 and 68 are interconnected by interconnecting channel portions 70 extending around the ends 36 of the arcuate member and defined partly by the spacing member 60.

The cylinder 32, arcuate member 34 and inner member 38 are maintained in axially fixed positions by holding means in the form of rigid metal bars 72 which extend radially of the assembly. These bars are attached either to the axial ends of the cylinder 32 or of the inner member 38 and extend across the end surfaces of the arcuate member 34. These bars 72 are omitted from FIG. 3 to simplify this Figure and to show the guides 50 in relation to the other parts of the position changing means.

As shown by the drawings, the guides 50 are held in spaced-apart positions by a chain and sprocket drive. This drive comprises a chain 74 (see FIGS. 4, 5 and 6) which comprises two flexible edge members 76 spaced apart by driving bars 78 which extend between the side members 76 and are of strong, wear resistant material such as steel or a suitable plastic. The side members are composed of steel cords 80 embedded in square cross-section plastic molding 82. The ends of the driving bars 78 are also embedded into the plastic material. The continuous chain 74 extends around the inner surface of the cylinder 32 as far as the spacing member 60, then continues around both of the curved surfaces 62 of the spacing member to continue around the surface of the inner member 38, except for the part of the inner member which confronts the spacing member. The chain lies within a recess 84 in the inner surface of the cylinder 32, as shown by FIG. 4, the recess being of constant width from top to bottom. The chain lies in a similarly shaped recess (not shown) in the inner member 38. As it proceeds along the surfaces 62 of the spacing member 60, however, the chain lies within a recess 86 (FIG. 5) which, while being similarly shaped to the other recesses, has edge flanges 88 which are provided to prevent the chain from emerging from the recess as it passes along the small radiused surface 62 of the spacing member. There is a driving means provided between the chain and both the cylinder 32 and the inner member 38. As shown by FIG. 6, each of the side members 76 has the plastic molding 82 formed integrally with lateral teeth 90 which engage driving projections (not shown) which project into the recesses of the cylinder 32 and of the inner member. Thus, rotation of either the cylinder or the inner member causes the chain 74 to rotate together with the driven member.

A further chain 92 is provided for the purpose of ensuring that the guides 50 maintain their spaced-apart positions in the channel as required. This chain is stationary and is secured within a continuous recess 96, which extends around the surface of the arcuate member 34. The chain 92 need not have the teeth 90 of chain 74 as chain 92 is not to be driven.

Each of the guides 50 is provided with a sprocket 97 which surrounds the guide and is secured to it, as shown clearly by FIGS. 4 and 5. Each sprocket has its teeth enmeshed with the driving bars 78 of the chain 74 and also enmeshed with the chain extending around the arcuate member 34.

A driving means is provided for the cylinder 32 in addition to the driving means provided for the inner member 38. The driving means for the cylinder 32 comprises a driving roller 98 which engages the cylinder outer surface and is equally spaced around the cylinder with three positioning rolls 100, which are secured to the frame to stabilize the cylinder 32. These rolls and the driving roller 98 are not shown in FIG. 3. The driving roll 98 is connected to a driving motor (not shown), the speed of which is synchronized with that of the motor 46 to ensure that the chain 74 is driven at the same speed by the cylinder and the inner member 38.

Upstream from the position changing means is a guide means to prevent conductor units from being twisted together as they are being passed towards the position changing means. This guide means comprises a roller 102 which, as shown in FIG. 7, is freely rotatably mounted in a frame 104 and is formed with a plurality of annular grooves 106.

In use of the apparatus, the conductor pairs 10 are fed from their individual reels 12 around the guide roller 102 towards the position changing means 30. Each conductor pair is located in its own individual groove 106 in the roller 102, as shown in FIG. 7, so that the pairs are prevented from twisting together as they approach the position changing means. Each pair passes through its own guide 50 in the position changing means and then continues downstream to the closing die, binding head and the stranding machine, as shown by FIG. 1. As the conductor pairs pass through their guides 50, the cylinder 32 and the inner member 38 are both rotated as described above, so that the chain 84 moves first in one direction and then in the opposite direction along its grooves. This chain movement causes all of the guides to move within the channel 64. Some of the guides move only in their respective channel portions while others move from one channel portion to another through the interconnecting channel portions 70. For instance, for a particlar direction of movement, as shown by FIG. 2, the guides in the outer channel portion are moving in an anticlockwise direction, as indicated by the arrows, whereas the guides in the inner channel portion move in a clockwise direction. This causes guides in the outer channel portion at the left hand side to move into the inner channel portion and guides on the right hand side of the inner channel portion to move into the outer channel portion. Hence, as can be seen, the guides in the inner channel portion vary in position relative to those in the outer channel portion for each direction of movement. Thus, the positions of the conductor pairs change from one channel portion to the other, first in one direction and then the other. As a result of this, as the conductor pairs move downstream from the guides 50 and into the closing die 16, their positions at the closing die are affected by the positions of the guides 50. Hence, the conductor pairs issuing from guides in each channel portion are influenced to be positioned adjacent to conductor pairs issuing from the other conductor portion and then adjacent to other conductor pairs as the positional change takes place. In addition to this, conductor pairs issuing from adjacent guides 50 of each channel portion do not necessarily continue to lie adjacent to each other because of the influence of the relative movement taking place between the pairs. For instance, if two conductor pairs from adjacent guides 50 do lie adjacent to each other at a certain position of rotation of the chain 84, then as movement continues, it is possible that other conductor pairs from the other channel will move in between these conductor pairs, thereby altering their positional relationship.

Thus, the conductor pairs are moved in an influenced fashion relative to each other. This movement, because of the curved nature of the chain 84 and the positions of the guides 50 around the two arcs of the channel, results in multi-directional movements of the conductor pairs, thereby providing a completely changing relationship of the conductor pairs in two or more planes. It follows that rollers are not required to complete the mixing together of the conductor pairs between the position changing means and the closing die. Hence, the position changing means, while being of simple construction, is all that is required to change the relative positions of the conductor pairs and achieve the object of lessening pair-to-pair capacitance unbalance and to reduce cross-talk between pairs.

What is claimed is:

1. Apparatus for forming a core unit from telecommunications conductor units, each formed from twisted together insulated conductors and in which the relative positions of the conductor units are changed along the core unit, the apparatus comprising, in order downstream along a feedpath for the conductor units:

guide means for the conductor units to prevent them from being twisted together;

position changing means for conductor units comprising an arcuate member surrounded by a rotatable annulus and an inner member, the position changing means defining an endless guide channel which extends transversely of the feedpath in a plurality of directions, the guide channel having an arcuate outer channel portion defined between the arcuate member and the annulus and an inner channel portion defined between the arcuate member and the inner member, the two portions subtending an angle of less than 360° around the axis of the annulus and interconnected at their ends by interconnecting channel portions extending around the ends of the arcuate member and defined between the arcuate member and a spacing member, the spacing member and inner member being mounted in position to a fixed support, the position changing means also comprising guides for conductor units held in laterally spaced positions in the channel, said guides maintaining the relative positions of the annulus, arcuate member, inner member and spacing member, and means to move the guides along the channel in their spaced positions for a certain distance alternately in each direction so that the guides are moved from channel portion to channel portion with guides in one channel portion changing in their positional relationship to those in the other, said guide moving means comprising a chain and sprocket drive, the chain being continuous and extending around the inner surface of the annulus, around the interconnecting channel portions and then around the inner member, the guide means also comprising a fixed chain provided around the circumference of the arcuate member, and each guide is provided with a sprocket of the guide moving means, which sprocket engages with both chains, and means is provided to drivably rotate the annulus; and a core unit forming and take-up means to draw the conductor units together to form the core unit.

2. Apparatus according to claim 1 wherein the inner member is also rotatable and has driving means connected to it.

* * * * *